US006540532B1

(12) United States Patent
Martin et al.

(10) Patent No.: US 6,540,532 B1
(45) Date of Patent: Apr. 1, 2003

(54) ELECTRICAL CONNECTOR ASSEMBLY FOR CONNECTING ELECTRICAL CONTACTS

(75) Inventors: Galen Monroe Martin, Camp Hill, PA (US); Hurley Chester Moll, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/093,550

(22) Filed: Mar. 8, 2002

Related U.S. Application Data

(60) Provisional application No. 60/341,590, filed on Dec. 13, 2001.

(51) Int. Cl.[7] ..... H01R 13/62
(52) U.S. Cl. ..... 439/157; 439/372
(58) Field of Search ..... 439/157, 372, 439/152, 153, 154, 155, 341–343, 310, 160

(56) References Cited

U.S. PATENT DOCUMENTS 5,172,998 A * 12/1992 Hatagishi ..... 403/27
5,322,448 A * 6/1994 Hahn ..... 439/157
5,344,194 A * 9/1994 Hatagishi et al. ..... 285/26
5,476,390 A * 12/1995 Taguchi et al. ..... 439/157
5,484,297 A * 1/1996 Takahashi et al. ..... 439/157
5,593,309 A 1/1997 Post et al. ..... 439/157
5,709,560 A * 1/1998 Hio ..... 439/157
5,722,843 A * 3/1998 Kerkhof et al. ..... 439/157
5,785,558 A 7/1998 Post et al. ..... 439/680
5,829,994 A * 11/1998 Oda et al. ..... 439/157
5,833,484 A 11/1998 Post et al. ..... 439/352
6,039,586 A * 3/2000 Kitamura ..... 439/157
6,099,330 A 8/2000 Gundermann et al. ..... 439/157
6,186,804 B1 * 2/2001 Smith et al. ..... 439/157
6,312,272 B1 * 11/2001 Gaupp et al. ..... 439/157
6,312,273 B1 * 11/2001 Hasegawa et al. ..... 439/157
6,325,647 B1 * 12/2001 May et al. ..... 439/157
6,368,125 B1 * 4/2002 Gundermann et al. ..... 439/157

* cited by examiner

*Primary Examiner*—P. Austin Bradley
*Assistant Examiner*—Ross Gushi

(57) ABSTRACT

An electrical connector is provided that includes first and second housings. The first and second housings are matable with one another to join corresponding electrical contacts. The first and second housings are movable between initial and final positions, at which corresponding electrical contacts partially and fully mate, respectively. The electrical connector includes a lever member having cam arms that engages the first and second housings. The cam arms move the first and second housings between the initial and final positions as the lever member is rotated. The first housing has deflectable ledges that retain the cam arms in a fixed position when the electrical connector is in the initial position thereby limiting movement of the lever member. The second housing has rails that align with and deflect the deflectable ledges away from the cam arms as the first housing is moved from the initial position into the second housing.

20 Claims, 9 Drawing Sheets

ELECTRICAL CONNECTOR ASSEMBLY FOR CONNECTING ELECTRICAL CONTACTS

RELATED APPLICATIONS

This application is related to, and claims priority from, Provisional Application No. 60/341,590 filed Dec. 13, 2001, titled "Method of Lever Retention," the complete subject matter of which is incorporated herein by reference in its entirety.

BACKGROUND OF THE INVENTION

Certain embodiments of the present invention generally relate to a lever-based connection assembly for engaging resisting components. More particularly, certain embodiments of the present invention relate to an electrical connector for connecting electrical contacts contained in separate housings.

In certain applications, electronic components require the mating of several electrical contacts, such as in automotive electrical components. The electronic component includes a connector housing that holds several electrical contacts, while a mating connector housing holds an equal number of electrical contacts. One connector housing includes male electrical contacts, while the other connector housing includes female electrical contacts. As the number of electrical contacts to be mated increases, it becomes difficult to fully join the mating connector housings because of friction between the mating electrical contacts. The connector housings are formed with an electrical connector that includes a lever-and-gear system to pull together the connector housings in order to overcome the frictional resistance created by the mating electrical contacts.

A conventional electrical connector includes a lever and first and second connector housings including electrical contacts. The first connector housing is configured to be positioned inside the second connector housing. The lever includes a handle and two lever arms that extend from, and are rotated alongside, end walls of the first connector housing. The second connector housing is slid onto and encloses the first connector housing and the lever arms to a point where the electrical contacts resist further insertion. Each lever arm includes a cam arm with gear teeth. Racks are situated within the second connector housing with each rack corresponding to the gear teeth of one of the cam arms. As the first connector housing is inserted into the second connector housing, the lever is oriented in a fixed position so that the cam arms are slid between the racks unobstructed and aligned to engage the racks.

As the handle is rotated in a first direction, the racks and cam arms engage and pull the first connector housing and lever downward into the second connector housing, mating the electrical contacts. Alternatively, as the handle is rotated in a second direction, the first connector housing is pulled upward out of the second connector housing, unmating the electrical contacts.

In order to maintain the lever in the necessary fixed position prior to insertion into the second connector housing, some electrical connectors have apertures in upper portions of the lever arms that receive, and are retained by, deflectable latches extending outward from the end walls of the first connector housing. When the first connector housing is positioned within the second connector housing, the latches are biased inward into the first connector housing to release the lever arms from the fixed position. However, to use the deflectable latches with the apertures requires the lever arms to be in a lowered position about the first connector housing. In order to position the first connector housing downward into the second connector housing, the lever is rotated upward to an upright position above the first connector housing. The lever therefore takes up more space and interferes with surrounding components when connecting the electrical contacts, thus limiting the number of components, with which the electrical connector is used.

Other electrical connectors maintain the lever in a fixed position with the lever arms extending upright from the first connector housing prior to insertion into the second connector housing so that the lever is rotated downward about the first connector housing to connect the electrical contacts. The lever arms include apertures near the cam arms that receive, and are retained by, protrusions extending out from the end walls of the first connector housing. When the first connector housing is positioned within the second connector housing, the lever is pushed with a force necessary to disengage the apertures from the protrusions to release the lever from the fixed position. However, the protrusions are small and engage only a small amount of surface area of the lever arms. Therefore, when slight forces are applied to the lever, the lever arms are prematurely released from the protrusions such that the lever is no longer in the fixed position. The protrusions also quickly wear down until the protrusions do not engage the lever at all.

Therefore, a need exists for an electrical connector that overcomes the above problems and addresses other concerns experienced in the prior art.

BRIEF SUMMARY OF THE INVENTION

Certain embodiments of the present invention include an electrical connector having first and second housings. The first and second housings have rear ends configured to receive electrical contacts, and front ends configured to be matable with one another to join corresponding electrical contacts. The first and second housings are movable between initial and final positions, at which corresponding electrical contacts partially and fully mate, respectively. The electrical connector includes a lever member having cam arms with retention apertures that engage the first housing and retention elements that engage the second housing. The cam arms move the first and second housings between the initial and final positions as the lever member is rotated through a range of motion about a rotational axis defined by the retention apertures. The first housing has deflectable ledges located along opposite sides of the cam arms. The deflectable ledges retain the cam arms in a fixed position when the first and second housings are in the initial position and thereby limit movement of the lever member within the range of motion. The second housing has rails therein that align with and deflect the deflectable ledges away from the cam arms as the first housing is moved from the initial position into the second housing.

Figure 1:
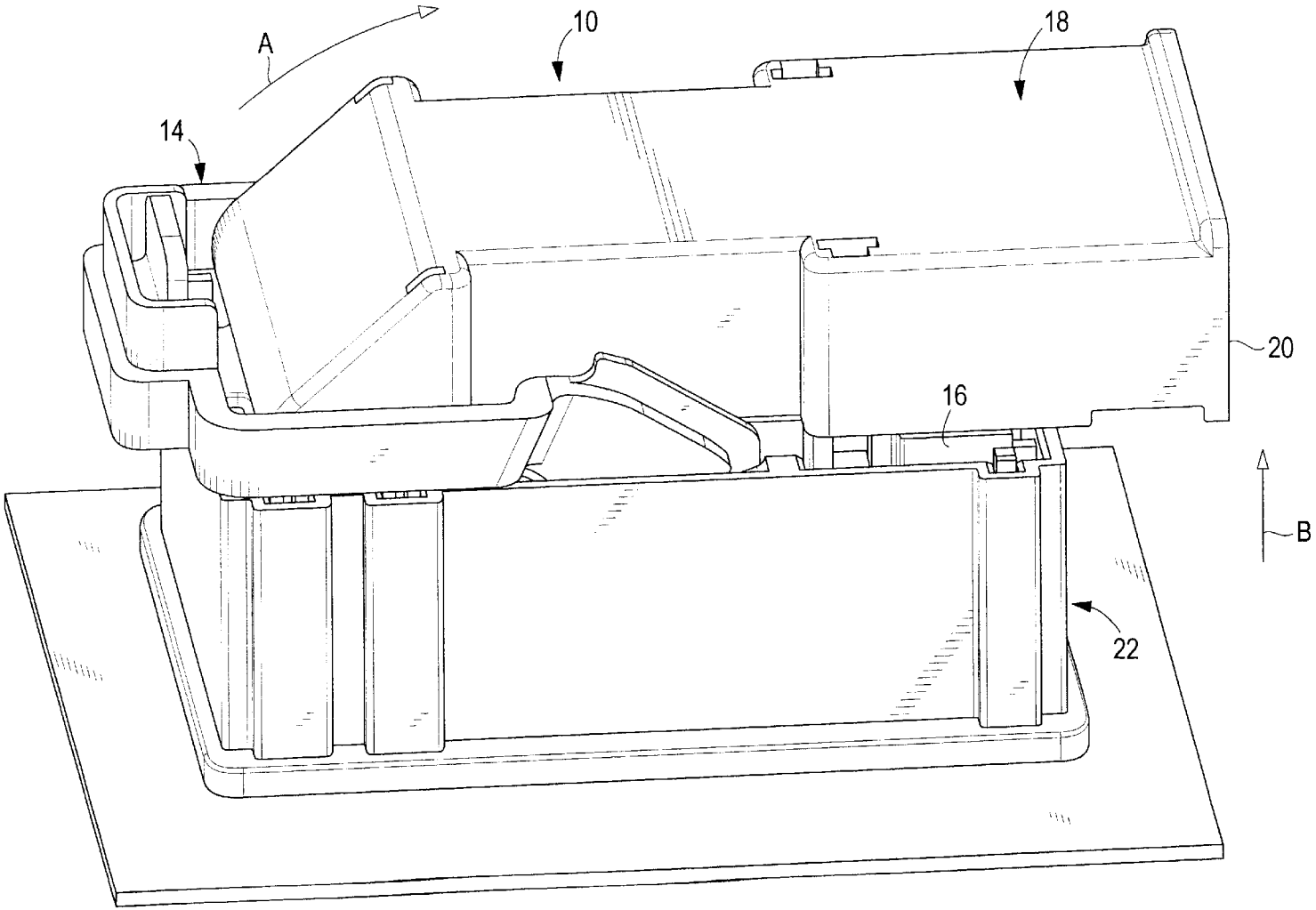
FIG. 1 illustrates a top isometric view of an electrical connector formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 7:
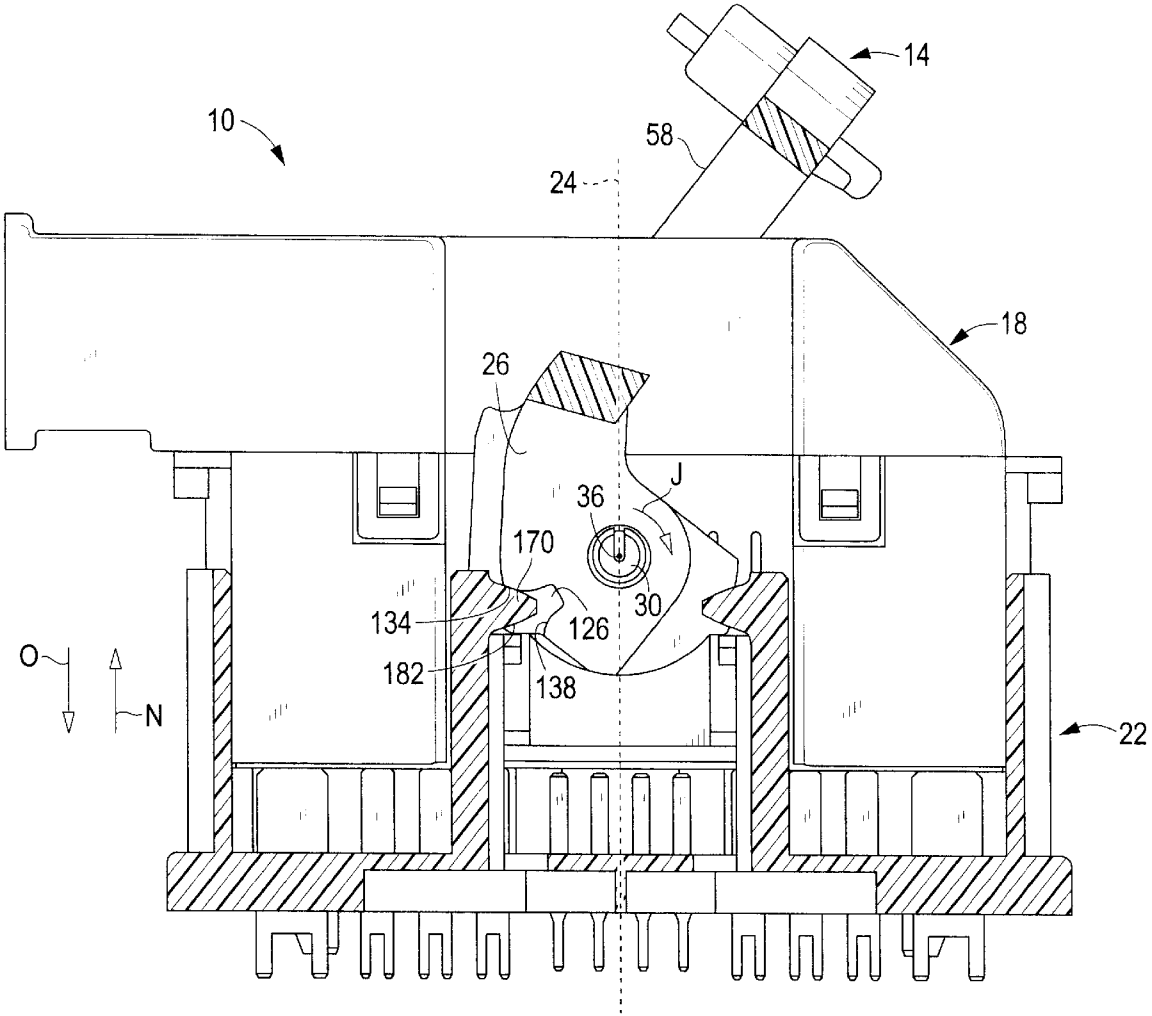
FIG. 7 illustrates a cutaway side view of the electrical connector of FIG. 1 while in the initial position.

FIG. 1 illustrates a top isometric view of an electrical connector 10 according to an embodiment of the present invention. The electrical connector 10 includes a harness connector 18 having a bottom portion 16 and a top portion 20. The bottom portion 16 is configured to receive packets that hold groups of electrical contacts while the top portion 20 covers the electrical contacts. A module connector 22 holds electrical contacts configured to mate with the electrical contacts in the harness connector 18. The harness connector 18 is inserted within the module connector 22 to a final position where the electrical contacts of the harness and module connectors 18 and 22 are fully mated (as shown in FIG. 1). A lever member 14 is retained on the exterior of the harness connector 18 and engages the module connector 22. The lever member 14 is rotatable in the direction of arrow A from the final position (FIG. 1) to an initial position (FIG. 7). As the lever member 14 is rotated, it pulls the harness connector 18 upward in the direction of arrow B out of the module connector 22 and disengages the electrical contacts of the harness connector 18 and the module connector 22.

Figure 2:
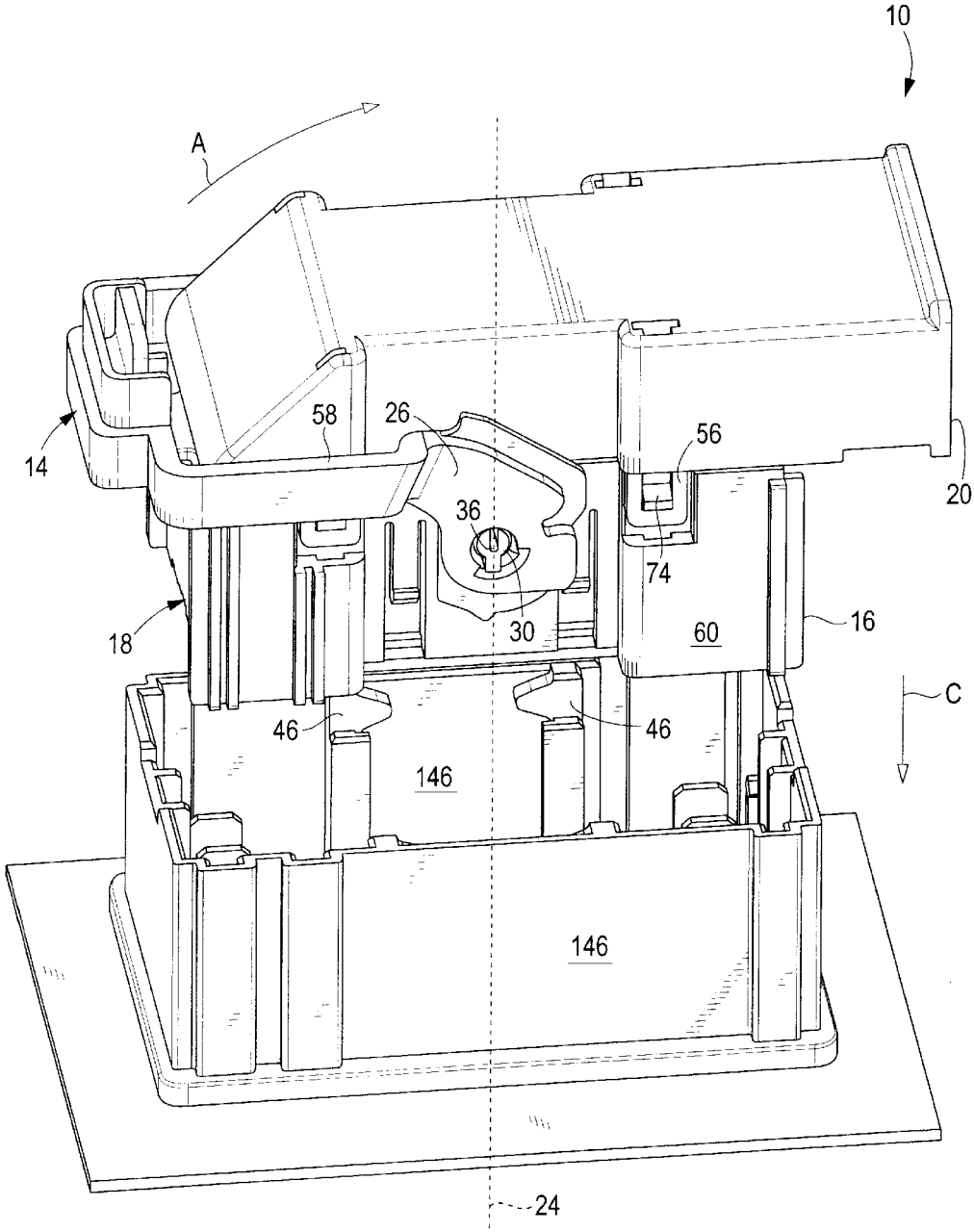
FIG. 2 illustrates an exploded isometric view of the electrical connector of FIG. 1.

FIG. 2 illustrates an exploded isometric view of the electrical connector 10 of FIG. 1. The lever member 14 includes cam arms 26 that rotate about pivot posts 30 extending outward from the harness connector 18 along a rotational axis 36. The lever member 14 is oriented with lever arms 58 aligned perpendicularly to a vertical axis 24. The module connector 22 includes mating posts 46 located alongside side walls 146 that engage the cam arms 26 when the harness connector 18 is positioned inside of the module connector 22. The top portion 20 and the bottom portion 16 of the harness connector 18 are fastened together by retention latches 56 extending from the top portion 20 and engaging latch catches 74 extending from side walls 60 of the bottom portion 16.

To insert the harness connector 18 into the module connector 22, the lever member 14 is rotated about the rotational axis 36 in the direction of arrow A until the lever arms 58 are aligned at a predetermined acute angle to the vertical axis 24 (e.g. 30°). The harness connector 18 and the lever member 14 are then inserted downward in the direction of arrow C into the module connector 22 until reaching an initial staging position which is shown in FIG. 7. When the harness connector 18 is in the initial staging position, each cam arm 26 is positioned to engage the opposing mating posts 46.

Figure 3:
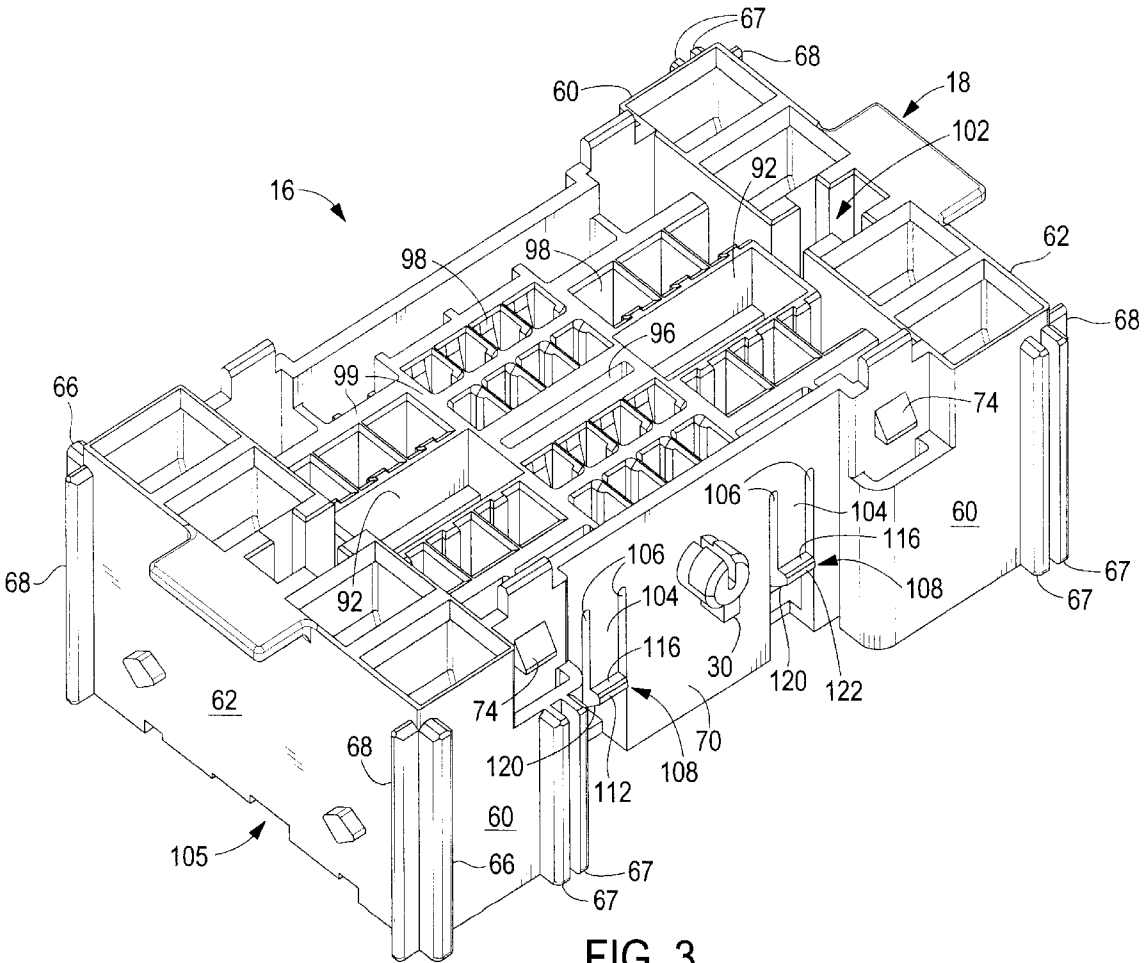
FIG. 3 illustrates an isometric view of the bottom portion of a harness connector formed according to an embodiment of the present invention.

FIG. 3 illustrates an isometric view of the bottom portion 16 of the harness connector 18 (FIGS. 1 and 2) in more detail. The bottom portion 16 is box shaped and includes the opposing side walls 60 and opposing end walls 62. The exterior perimeter of the bottom portion 16 is smaller than an interior perimeter of the module connector 22 of FIGS. 1 and 2, in order that the harness connector 18 may be positioned within the module connector 22.

Double securing rails 67 are located on opposite side walls 60 at one end of the bottom portion 16 and single securing rails 66 are located on opposite side walls 60 at an opposite end of the bottom portion 16. Double securing rails 67 are also located proximate the single securing rails 66. The single and double securing rails 66 and 67 are sidably received by cavities 100 (FIG. 4) within the module connector 22 with the harness connector 18 oriented to be inserted into the module connector 22.

The pivot posts 30 extend outward from the centers of recessed portions 70 of the side walls 60. Each cam arms 26 (FIG. 2) enclose and rotate about the pivot posts 30 along the recessed portions 70. When the harness connector 18 is positioned within the module connector 22, the cam arms 26 are rotatable between the recessed portion 70 and the side walls 146 (FIG. 4) of the module connector 22. The side walls 60 also include the triangular latch catches 74 that snapably engage the retention latches 56 (FIG. 2) formed on the top portion 20.

End securing rails 68 extend outward from the end walls 62 proximate opposite corners of the end walls 62. The end securing rails 68 are slidably received within the module connector 22 and engage end walls 150 (FIG. 4) of the module connector 22.

Figure 4:
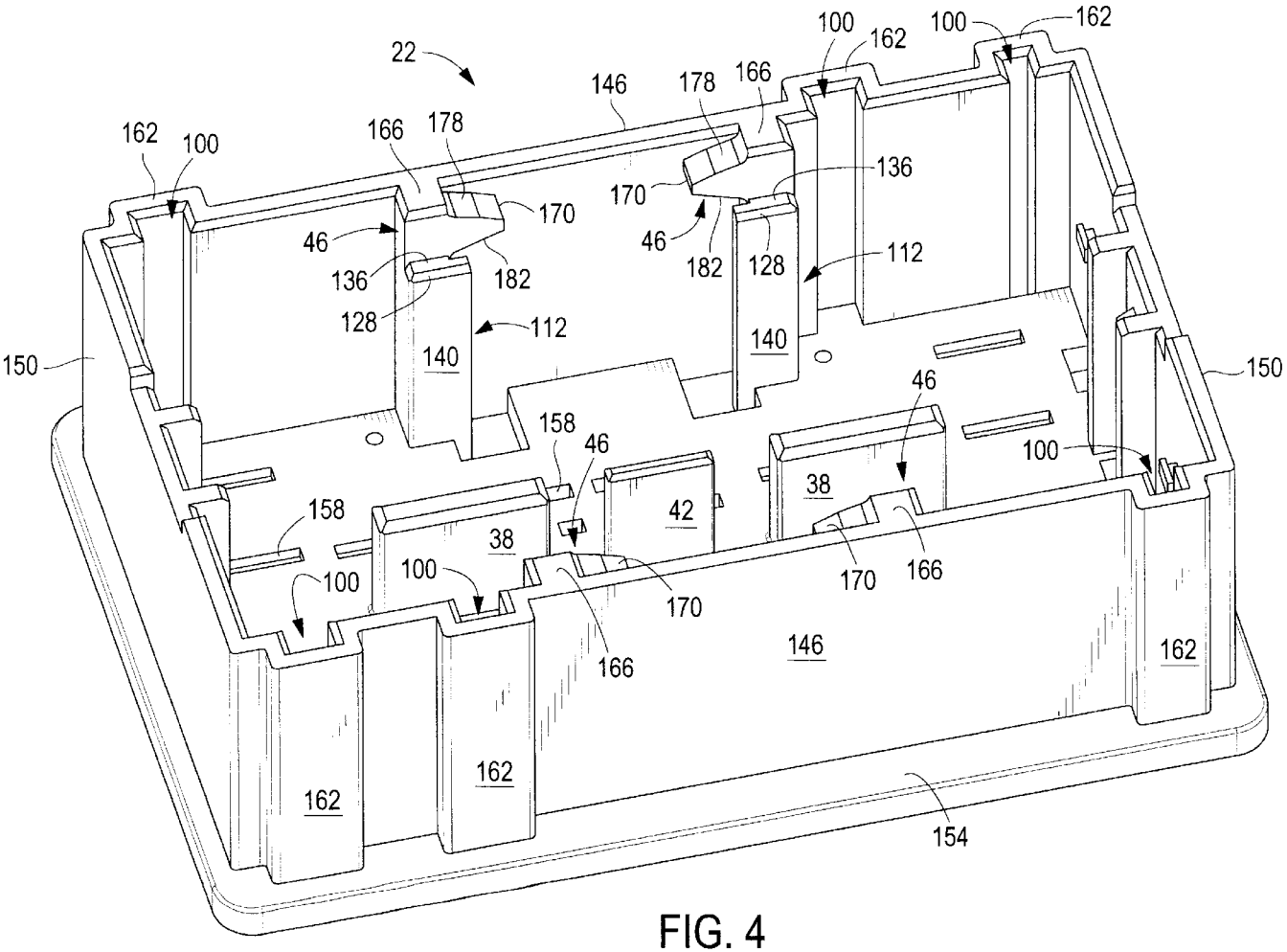
FIG. 4 illustrates an isometric view of a module connector formed according to an embodiment of the present invention.

The bottom portion 16 includes several connector pockets 98 of varying shapes and sizes formed with walls 99 extending from the side and end walls 60 and 62. The connector pockets 98 extend throughout the harness connector 18 from an open top section 102 to an open bottom section 105. The connector pockets 98 hold the electrical contacts that are mated with the electrical contacts contained within the module connector 22 (FIG. 4). Centered within the bottom portion 16 between sets of connector pockets 98 are large and small alignment recesses 92 and 96. The large and small alignment recesses 92 and 96 extend through the module connector 22 and receive and enclose large and small alignment posts 38 and 42 (FIG. 4) mounted in the module connector 22 when the harness connector 18 is positioned within the module connector 22.

The recessed portions 70 also include deflectable beams 104 that are formed with the recessed portions 70 at first ends and include retention wedges 108 at second ends. The deflectable beams 104 extend downward into gaps 106 within the recessed portions 70 and are aligned along a plane with the recessed portions 70. The retention wedges 108 extend outward from the deflectable beams 104 beyond the plane of the recessed portions 70. The retention wedges 108 include flat resistance surfaces 116 that extend perpendicularly outward from the deflectable beams 104 to join flat side surfaces 122. Beveled bottom surfaces 120 extend at an acute angle from the side surfaces 122 to the second ends of the deflectable beams 104. The resistance surfaces 116 engage the cam arms 26 (FIG. 2) at flat securing ledges 144 (FIG. 5) at opposite ends and thus prevent the cam arms 26 from rotating about the rotational axis 36 as described below. The deflectable beams 104 may be biased inward into the harness connector 18 when resisted by deflection rails 112 (FIG. 4) extending from the side walls 146 of the module connector 22 as the harness connector 18 is moved into the module connector 22 from the initial position to the final position.

FIG. 4 illustrates an isometric view of the module connector 22 in more detail. The two side walls 146 are formed integral with, and are aligned perpendicular to, the end walls 150. The side and end walls 146 and 150 are formed integral with, and extend upward from, a base 154. The base 154 is mounted to an electronic component (not shown), such as a radio, with the side and end walls 146 and 150 extending outward from the electronic component. Several contact slots 158 of varying sizes and shapes extend through the base 154. The electrical contacts positioned within the module connector 22 are connected to the electronic component through the contact slots 158. The large and small alignment posts 38 and 42 also extend upward from the center of the base 154.

The side walls 146 include rail chambers 162 along the exteriors thereof that define cavities 100 along the interiors of the side walls 146. The rail chambers 162 are appropriately situated along each side wall 146 such that when the harness connector 18 (FIG. 3) is positioned within the module connector 22, the cavities 100 receive corresponding single and double securing rails 66 and 67 situated on the side walls 60 of the harness connector 18. Thus the rail chambers 162 retain the securing rails 66 and 67 and guide the harness connector 18 into the module connector 22 in the proper orientation.

The mating posts 46 extend inward from the side walls 146 facing one another. The mating posts 46 are oriented opposite to mating posts 46 extending from the other side wall 146. Each side wall 146 may include two mating posts 46 to permit the lever member 14 and the top portion 20 (FIG. 2) of the harness connector 18 to be connected to the bottom portion 16 in either one of two orientations with each cam arm 26 (FIG. 2) still engaging a mating post 46 when the harness connector 18 is inside the module connector 22.

The mating posts 46 are rectangular in shape and include flat top surfaces 166. A wedge shaped tooth 170 extends from an inside wall of each mating post 46 proximate the top surface 166. The tooth 170 includes a top portion 178 that extends downward at an acute angle from the top surface 166 to a bottom portion 182 that extends upward from, and at an obtuse angle to, the inside wall. In operation, when the cam arms 26 (FIG. 2) are rotated to move the electrical connector 10 from the initial staging position to the final position, the cam arms 26 engage, and are resisted by, the bottom portions 182. Alternatively, when the cam arms 26 are rotated to move the electrical connector 10 from the final position to the initial staging position, the cam arms 26 engage, and are resisted by, the top portions 178.

Deflection rails 112 extend inward from each mating post 46 toward the opposite side wall 146. The deflection rails 112 along each side wall 146 are oriented opposite deflection rails 112. The deflection rails 112 are rectangular in shape and include beveled surfaces 128 that slope downward at an acute angle (similar to the angle of the bottom surfaces 120 of the retention wedges 108 of FIG. 3) from a top surface 136 to a front surface 140. As the harness connector 18 is moved into the module connector 22, the front surfaces 140 of the deflection rails 112 slide along the recessed portions 70 of the harness connector 18. The bottom surfaces 120 of the retention wedges 108 slidably engage the beveled surfaces 128 of the deflection rails 112. The deflection rails 112 resist the retention wedges 108 and the deflectable beams 104 are pushed inward into the harness connector 18 until the retention wedges 108 are aligned along the plane of the recessed portions 70.

Figure 5:
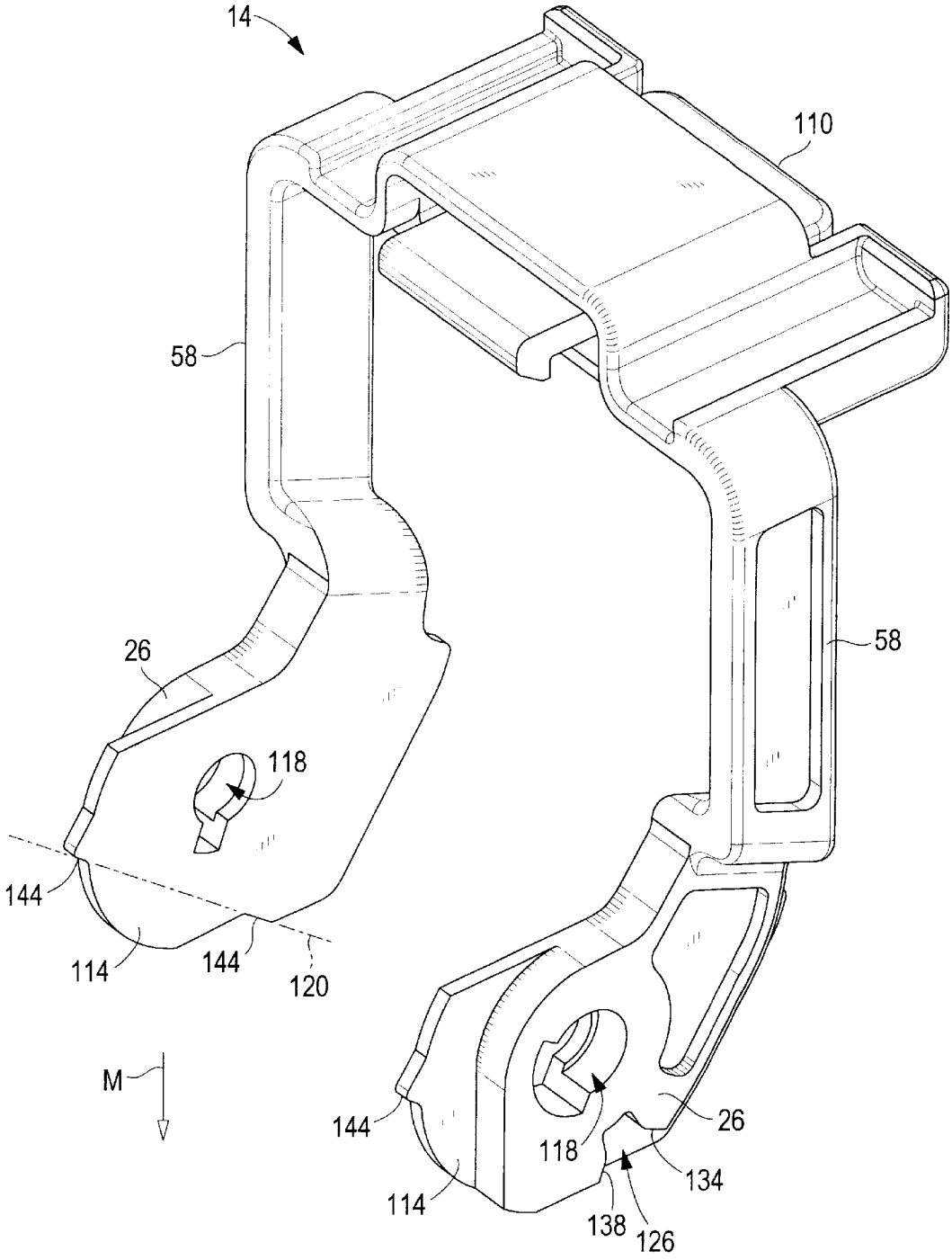
FIG. 5 illustrates an isometric view of a lever member formed according to an embodiment of the present invention.

FIG. 5 illustrates an isometric view of the lever member 14 in more detail. A handle 110 is formed integral with, and extends between, the lever arms 58, which in turn project parallel to one another and join corresponding cam arms 26. Thin contact bases 114 extend along inside surfaces of the cam arms 26, and retention apertures 118 are provided through the cam arms 26 and contact bases 114. The contact bases 114 include the securing ledges 144 that project forward along parallel horizontal planes 120. The lever member 14 is attached to the harness connector 18 (FIG. 3) by deflecting the lever arms 58 outward away from each other until the contact bases 114 slide over the pivot posts 30 (FIG. 3) and the pivot posts 30 are enclosed within the retention apertures 118. As the lever member 14 is moved downward in the direction of arrow M onto the pivot posts 30, the securing ledges 144 become oriented parallel to abut against the resistance surfaces 116 of the retention wedges 108 (FIG. 3), thereby orienting the lever arms 58 at a predetermined acute angle to the vertical axis 24 (FIG. 2), which ensures proper alignment between the mating posts 46 and the notches 126.

Each cam arm 26 includes a notch 126 formed in the peripheral surface thereof. The notch 126 includes an ungearing surface 134 and a gearing surface 138 facing one another. When the lever member 14 is rotated to move the electrical connector 10 from the initial position (FIG. 7) to the final position (FIG. 8), the gearing surfaces 138 engage the bottom portions 182 of the teeth 170 of the mating posts 46 (FIG. 2) as described below. Alternatively, when the lever member 14 is rotated to move the electrical connector 10 from the final position to the initial staging position, the ungearing surfaces 134 engage the top portions 178 of the teeth 170 of the mating posts 46 as described below.

Figure 9:
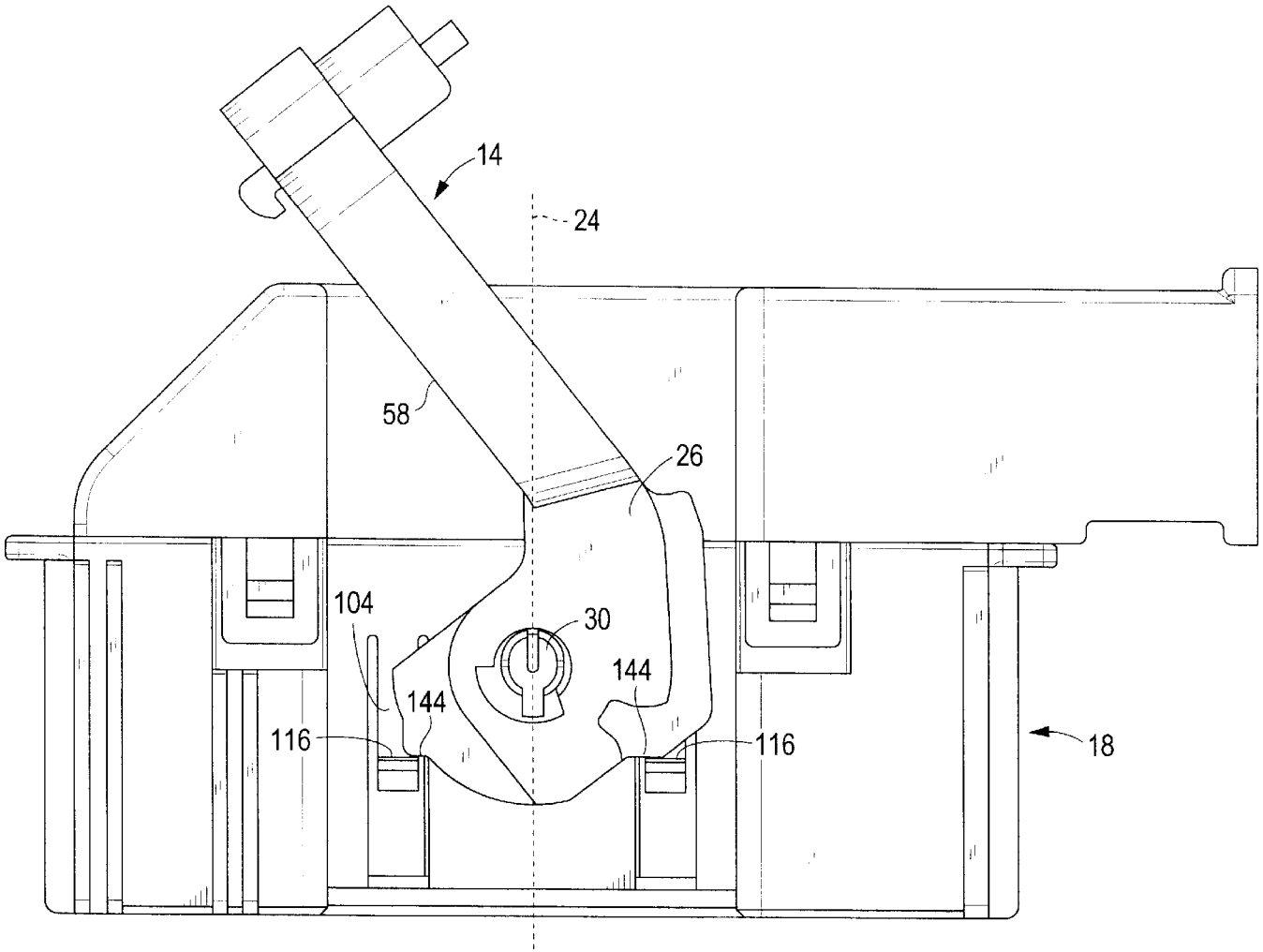
FIG. 9 illustrates a side view of the lever member and the harness connector.

FIG. 9 illustrates a side view of the lever member 14 and the harness connector 18. When the cam arms 26 are fully inserted about the pivot posts 30, the securing ledges 144 engage, and are resisted by, the resistance surfaces 116 such that the lever member 14 is held in a fixed position and prevented from rotating. The lever arms 58 are thus maintained upright at a predetermined acute angle to the vertical axis 24, and the cam arms 26 are properly oriented to be inserted between the mating posts 46 (FIG. 4). The harness connector 18 and the lever member 14 are then inserted into the module connector 22 (FIG. 4) to the initial position where the deflection rails 112 engage the deflectable beams 104. As the deflection rails 112 engage the deflection beams 104, the deflection beams 104 are biased inward toward the harness connector 18 until the resistance surfaces 116 no longer contact the securing ledges 144 and no longer impede the rotation of the lever member 14.

Figure 6:
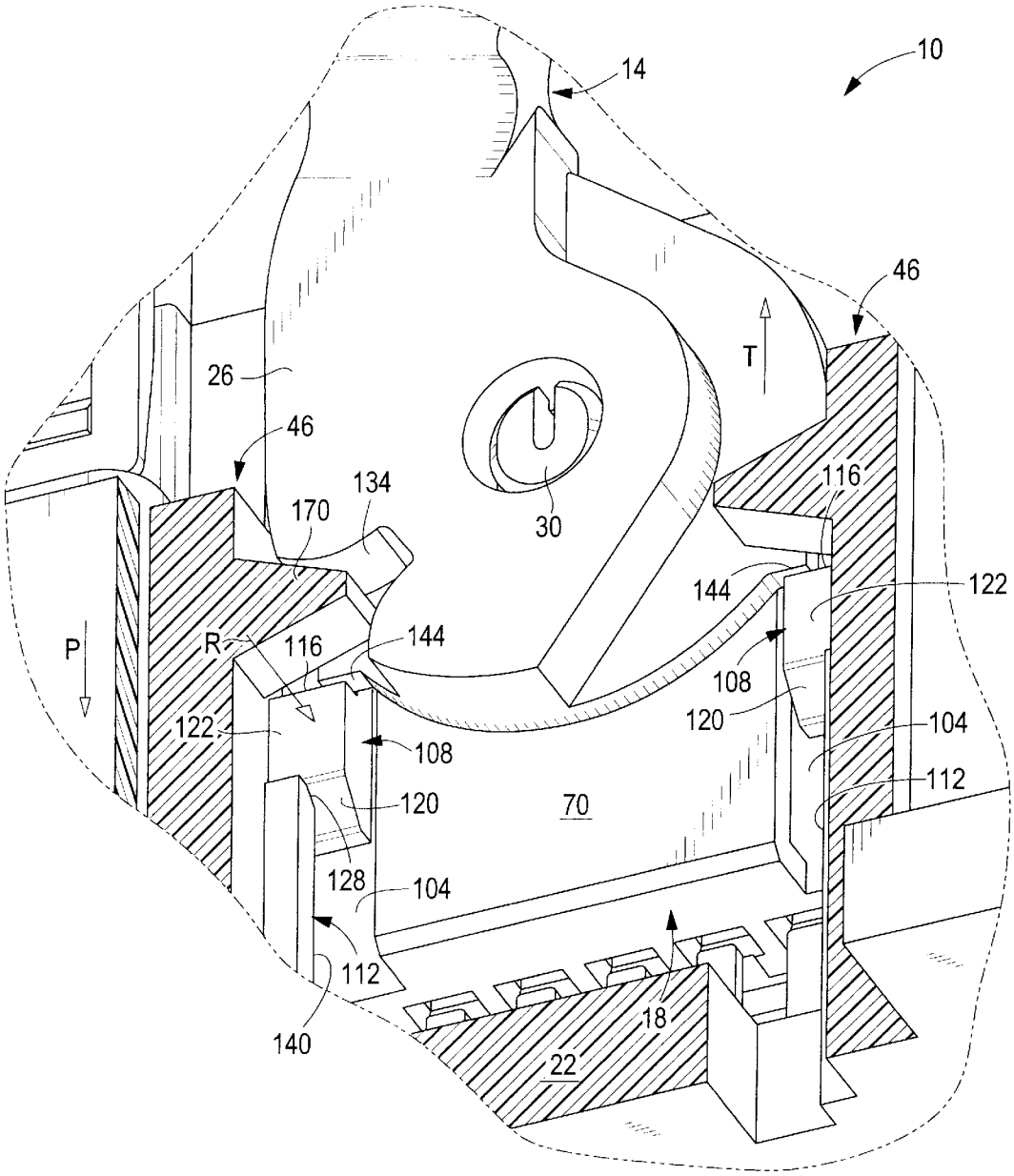
FIG. 6 illustrates a close-up cutaway side view of a portion of the electrical connector of FIG. 1 with the lever member in the fixed position.

FIG. 6 illustrates a close-up cutaway side view of a portion of the electrical connector 10 of FIG. 1 with the lever member 14 in the fixed position. The harness connector 18 is moved in the direction of arrow P into the module connector 22 until reaching the initial position. The resistance surfaces 116 engage the securing ledges 144 and the lever member 14 is prevented from rotating. Thus the ungearing surfaces 134 are properly aligned above the teeth 170 and the cam arms 26 are properly oriented to slide between and engage the mating posts 46.

As the harness connector 18 is fully moved into the initial position, the bottom surfaces 120 of the retention wedges 108 slide against the beveled surfaces 128 of the deflection rails 112.

The deflection rails 112 bias the retention wedges 108 in the direction of arrow R to deflect the retention wedges 108 and deflectable beams 104 inward toward the harness connector 18 in the direction of arrow R. When the retention wedges 108 are deflected inward, the side surfaces 122 are able to slide along the front surfaces 140 of the deflection rails 112. Hence, the resistance surfaces 116 no longer engage the securing ledges 144 and the lever member 14 is rotatable about the pivot posts 30. Alternatively, when the harness connector 18 is pulled upward in the direction of arrow T out of the module connector 22, the deflectable beams 104 return to an unbiased position and the resistance surfaces 116 retain the cam arms 26 in the fixed position.

FIG. 7 illustrates a cutaway side view of the electrical connector 10 of FIG. 1 while in the initial position. The lever arms 58 are oriented at an acute angle to the vertical axis 24 and the teeth 170 are partially situated within the notches 126 to engage the ungearing surfaces 134. In order to further insert the harness connector 18 within the module connector 22 and mate the electrical contacts, the lever member 14 is rotated in the direction of arrow J about the rotational axis 36 of the pivot posts 30. As the lever member 14 is rotated about the rotational axis 36 in the direction of arrow J, the gearing surfaces 138 engage the bottom portions 182 of the teeth 170, and the bottom portions 182 resist the upward motions of the gearing surfaces 138 in the direction of arrow N, causing the cam arms 26 to pull the pivot posts 30 vertically downward in the direction of arrow O. As the pivot posts 30 are pulled downward, the harness connector 18 is in turn pulled downward into the final position (FIG. 8) with sufficient force to overcome the static and dynamic friction between the mating electrical contacts thereby fully connecting the electrical contacts.

Figure 8:
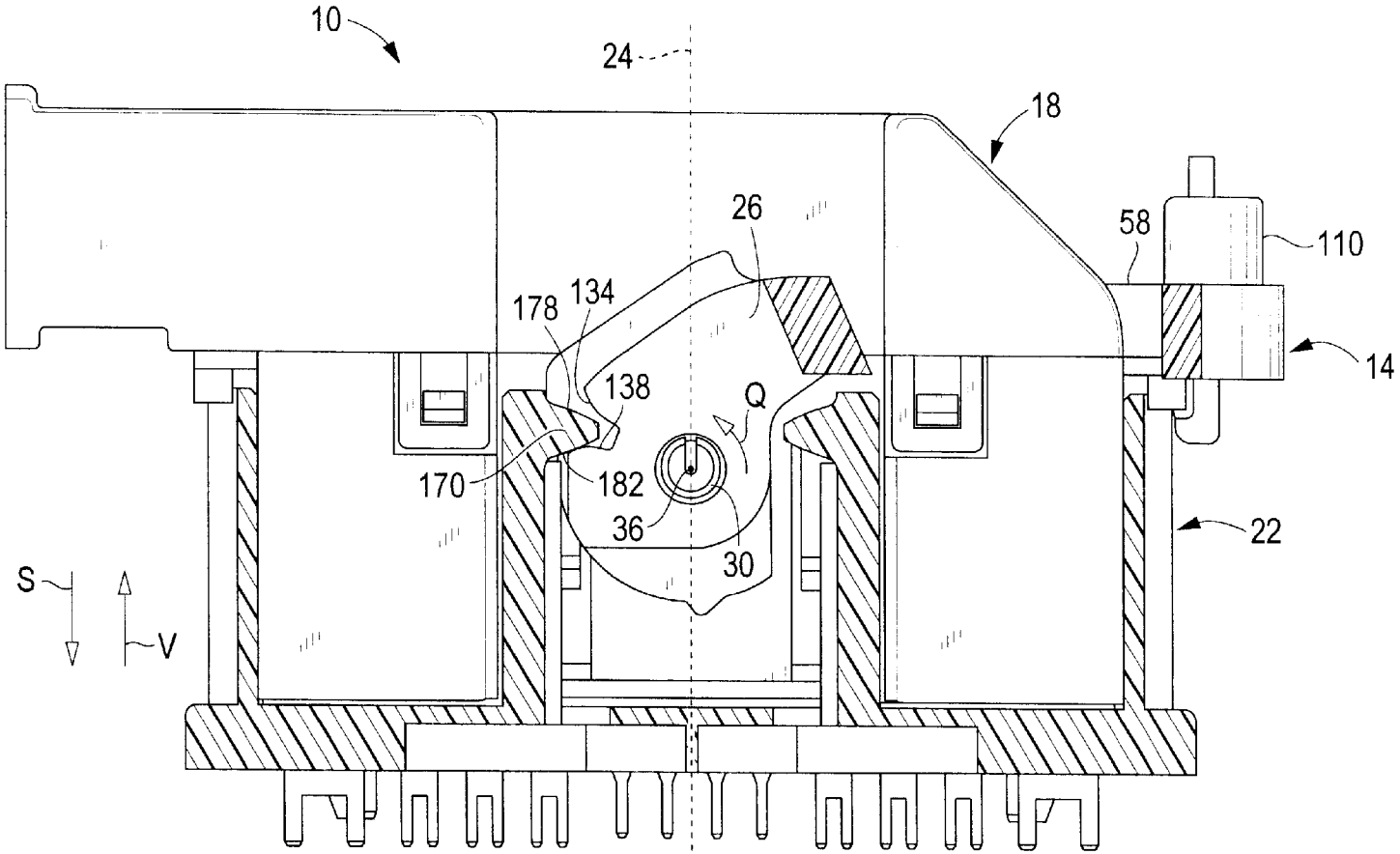
FIG. 8 illustrates a cutaway side view of the electrical connector of FIG. 1 in the final position.

FIG. 8 illustrates a cutaway side view of the electrical connector 10 of FIG. 1 in the final position. The lever arms 58 are oriented horizontally, with respect to the vertical axis 24 and the gearing surfaces 138 are engaged with the bottom portions 182 of the teeth 170. The electrical contacts in the harness connector 18 are fully mated with the electrical contacts in the module connector 22. To unmate the electrical contacts and return the harness connector 18 to the initial position, an operator uses the handle 110 to rotate the lever member 14 in the direction of arrow Q about the rotational axis 36. As the lever member 14 is rotated in the direction of arrow Q about the rotational axis 36, the ungearing surfaces 134 engage the top portions 178 of the teeth 170, and the top portions 178 resist the downward motions of the ungearing surfaces 134 in the direction of arrow S, causing the cam arms 26 to pull the pivot posts 30 vertically upward in the direction of arrow V. As the pivot posts 30 are pulled upward, the harness connector 18 is in turn pulled upward into the initial position (FIG. 7) with enough force to overcome the static and dynamic friction between the mating electrical contacts and disconnect the electrical contacts.

The electrical connector confers several benefits. Among others, the retention wedges on the deflectable strips engage the securing ledges of the cam arms when the lever member is positioned about the harness connector. By engaging the securing ledges at opposite ends along the cam arm, the retention wedges maintain the lever member in the fixed position so that the lever member is lowered into the module connector with the cam arms properly aligned between the mating posts. Secondly, the deflection rails engage the deflectable strips as the harness connector is moved into the module connector into the initial position so that the retention wedges are pushed away from the securing ledges. When the retention wedges no longer engage the securing ledges, the lever arm is rotated to move the harness connector between the initial position and the final position.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector, comprising:

first and second housings having rear ends configured to receive electrical contacts, said first and second housings having front ends configured to be matable with one another to join corresponding electrical contacts, said first and second housings being movable between initial and final positions, at which corresponding electrical contacts partially and fully mate, respectively;

a lever member including cam arms having retention apertures that engage said first housing and having retention elements that engage said second housing, said cam arms moving said first and second housings between said initial and final positions as said lever member is rotated through a range of motion about a rotational axis defined by said retention apertures; and said first housing having deflectable ledges located along opposite sides of said cam arms, said deflectable ledges retaining said cam arms in a fixed position when said first and second housings are in said initial position and thereby limiting movement of said lever member within said range of motion; and said second housing having rails therein that align with and deflect said deflectable ledges away from said cam arms as said first housing is moved from said initial position into said second housing.

2. The electrical connector of claim 1, wherein said cam arms have catches formed in peripheral surfaces of said cam arms, said catches engaging said deflectable ledges to orient said cam arms at a predetermined angle with respect to said first housing.

3. The electrical connector of claim 1, wherein said ledges include top surfaces that resist rotation of said cam arms when said first and second housings are in said initial position.

4. The electrical connector of claim 1, wherein said rails extend inward from interior side walls of said second housing and have beveled top surfaces and said deflectable ledges are located along interior walls of said first housing such that said deflectable ledges slidably engage said rails and have beveled bottom surfaces that complement said beveled top surfaces such that, as said bottom surfaces of said deflectable ledges slidably engage said top surfaces of said rails, said deflectable ledges are deflected inwards by said rails and into said first housing.

5. The electrical connector of claim 1, wherein said rails have front surfaces and said deflectable ledges have retention wedges that engage said cam arms and have side surfaces, said front surfaces and side surfaces slidably engaging each other such that said retention wedges deflect inward into said first housing disengaged from said cam arms with said side walls aligned along a plane with side walls of said first housing.

6. The electrical connector of claim 1, wherein said lever member is oriented upright at an angle to a top surface of said first housing when in said fixed position and oriented parallel to, and resting upon, said top surface when said first and second housings are in said final position.

7. The electrical connector of claim 1, wherein said lever member is oriented parallel to, and resting upon, a top surface of said first housing when in said fixed position, and oriented upright at an angle to said top surface when said first and second housings are in said final position.

8. The electrical connector of claim 1, wherein said cam arms include notches formed in a peripheral surface thereof, said notches including first and second gearing surfaces, said first gearing surfaces engaging said second housing to move said first and second housings from said initial position to said final position, said second gearing surfaces engaging said second housing to move said first and second housings from said final position to said initial position.

9. The electrical connector of claim 1, wherein said retention apertures rotatably engage pivot posts extending from exterior side walls of said first housing between mating posts extending from interior side walls of said second housing, said mating posts including teeth with top and bottom surfaces, said bottom surfaces engaging said cam arms as said lever member is rotating through said range of motion to move said first and second housings from said initial position to said final position, said top surfaces engaging said cam arms as said lever member is rotating through said range of motion to move said first and second housings from said final position to said initial position.

10. The electrical connector of claim 1, wherein said lever member extends from opposite exterior side walls of said first housing between opposite interior side walls of said second housing from which extends opposing mating posts, said cam arms rotating between and engaging said mating posts to move said first and second housings between said initial and final positions.

11. An electrical connector, comprising:

first and second housings having rear ends configured to receive electrical contacts, said first and second housings having front ends configured to be matable with one another to join corresponding electrical contacts, said first and second housings being movable between initial and final positions, at which corresponding electrical contacts partially and fully mate, respectively;

a lever member including cam arms having retention apertures that engage said first housing and having first and second gear surfaces that engage mating posts extending from interior walls within said second housing, said cam arms moving said first and second housings between said initial and final positions as said lever member is rotated through a range of motion about a rotational axis defined by said retention apertures; and said first housing having deflectable ledges located along opposite sides of said cam arms, said deflectable ledges retaining said cam arms in a fixed position when said first and second housings are in said initial position and thereby limiting movement of said lever member within said range of motion;

said second housing having rails that extend from said mating posts that align with and deflect said deflectable ledges away from said cam arms as said first housing is moved from said initial position into said second housing.

12. The electrical connector of claim 11, wherein said cam arms have catches formed in peripheral surfaces of said cam arms, said catches engaging said deflectable ledges to orient said cam arms at a predetermined angle with respect to said first housing.

13. The electrical connector of claim 11, wherein said ledges include top surfaces that resist rotation of said cam arms when said first and second housings are in said initial position.

14. The electrical connector of claim 11, wherein said lever member is oriented upright at an angle to a top surface of said first housing when in said fixed position and oriented parallel to, and resting upon, said top surface when said first and second housings are in said final position.

15. The electrical connector of claim 11, wherein said lever member is oriented parallel to, and resting upon, a top surface of said first housing when in said fixed position, and oriented upright at an angle to said top surface when said first and second housings are in said final position.

16. The electrical connector of claim 11, wherein said rails have front surfaces and said deflectable ledges have retention wedges that engage said cam arms and have side surfaces, said front surfaces and side surfaces sidably engaging each other such that said retention wedges deflect inward into said first housing disengaged from said cam arms with said side walls aligned along a plane with side walls of said first housing.

17. The electrical connector of claim 11, wherein said mating posts have teeth with top and bottom surfaces, said first gearing surfaces engaging said bottom surfaces to move said first and second housings from said initial position to said final position, said second gearing surfaces engaging said top surfaces to move said first and second housings from said final position to said initial position.

18. The electrical connector of claim 11, wherein said rails extend inward from said interior side walls of said second housing and have beveled top surfaces and said deflectable ledges are located along interior walls of said first housing such that said deflectable ledges slidably engage said rails and have beveled bottom surfaces that complement said beveled top surfaces such that, as said bottom surfaces of said deflectable ledges slidably engage said top surfaces of said rails, said deflectable ledges are deflected inwards by said rails and into said first housing.

19. The electrical connector of claim 11, wherein said retention apertures rotatably engage pivot posts extending from exterior side walls of said first housing.

20. The electrical connector of claim 11, wherein said lever member extends from opposite exterior side walls of said first housing between opposite interior side walls of said second housing from which extends opposing mating posts, said cam arms rotating between and engaging said mating posts to move said first and second housings between said initial and final positions.

* * * * *